US010591155B2

(12) United States Patent
Özbey et al.

(10) Patent No.: US 10,591,155 B2
(45) Date of Patent: Mar. 17, 2020

(54) CIRCULATING FLUIDIZED BED APPARATUS

(71) Applicant: DOOSAN LENTJES GMBH, Ratingen (DE)

(72) Inventors: Nedim Özbey, Leichlingen (DE); Oguzhan Narin, Sprockhövel (DE)

(73) Assignee: DOOSAN LENTJES GMBH, Ratingen (DE)

( * ) Notice: Subject to any disclaimer, the term of this patent is extended or adjusted under 35 U.S.C. 154(b) by 0 days.

(21) Appl. No.: 15/540,608

(22) PCT Filed: Aug. 25, 2016

(86) PCT No.: PCT/EP2016/070060
§ 371 (c)(1),
(2) Date: Jun. 29, 2017

(87) PCT Pub. No.: WO2018/036628
PCT Pub. Date: Mar. 1, 2018

(65) Prior Publication Data
US 2019/0170345 A1 Jun. 6, 2019

(51) Int. Cl.
*F23C 10/10* (2006.01)

(52) U.S. Cl.
CPC ..... *F23C 10/10* (2013.01); *F23C 2206/103* (2013.01)

(58) Field of Classification Search
CPC ..... F23C 10/10; F23C 2206/103
See application file for complete search history.

(56) References Cited

U.S. PATENT DOCUMENTS 4,761,131 A * 8/1988 Abdulally ..... B01J 8/388 110/245
4,815,418 A * 3/1989 Maeda ..... F22B 31/0015 110/245

(Continued)

FOREIGN PATENT DOCUMENTS

DE 3107 356 A1 9/1982
DE 10 2013 110 624 A1 3/2015

(Continued)

OTHER PUBLICATIONS

Communication from the International Searching Authority dated Apr. 18, 2017 in PCT/EP2016/070060.

*Primary Examiner* — Nathaniel Herzfeld
(74) *Attorney, Agent, or Firm* — Invenstone Patent, LLC

(57) ABSTRACT

The invention relates to a circulating fluidized bed apparatus, comprising a combustion chamber (CC) with at least one outlet port (OP) at its upper end (UE) to transfer a mixture of gas and solids from said combustion chamber (CC) into at least one subsequent separator (SP) and from there at least partially back into the combustor chamber, wherein the combustion chamber (CC) is ring-shaped, comprising an inner wall (IW) and an outer wall (OW), arranged at a distance to each other in a radial direction of the combustion chamber (CC), and at least two intermediate walls (SW), which extend between the inner wall (IW) and the outer wall (OW) and in spaced relationship in a circumferential direction of the combustion chamber (CC), thereby subdividing the combustion chamber (CC) into a corresponding number of sections (CO), arranged adjacent to each other in the circumferential direction of the combustion chamber (CC).

15 Claims, 4 Drawing Sheets

(56) References Cited

U.S. PATENT DOCUMENTS

Figure 1:
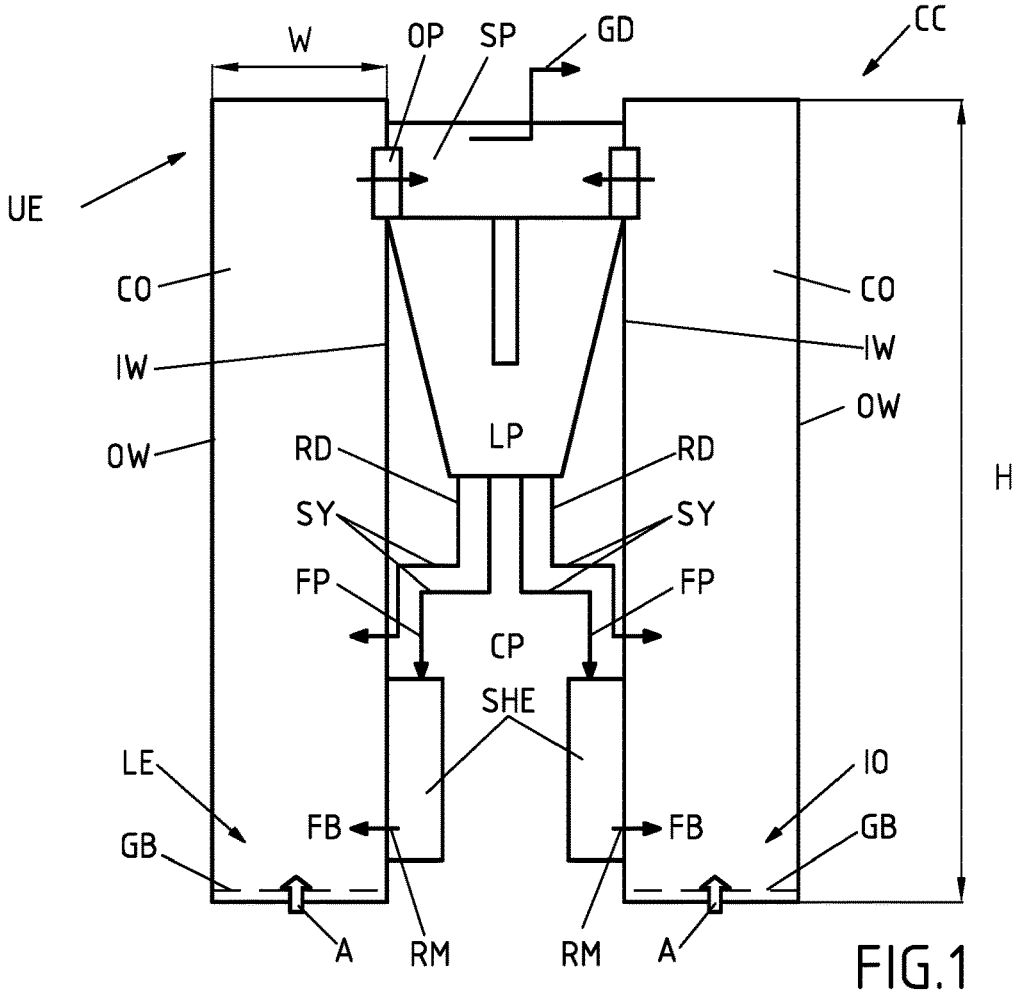

| | | | | |
|---|---|---|---|---|
| 5,215,042 | A * | 6/1993 | Beisswenger | B01J 8/386 110/245 |
| 5,911,201 | A * | 6/1999 | Eickenberg | F22B 31/0084 110/245 |
| 6,470,833 | B1 | 10/2002 | Hyppänen | |
| 6,481,385 | B1 * | 11/2002 | Gummel | F22B 31/0084 110/245 |
| 2003/0089318 | A1 | 5/2003 | Watanabe | |
| 2006/0011148 | A1 * | 1/2006 | Baglione | F23C 10/10 122/4 D |
| 2007/0079773 | A1 * | 4/2007 | Morin | F23C 10/10 122/459 |
| 2014/0299027 | A1 | 10/2014 | Lu et al. | |

FOREIGN PATENT DOCUMENTS

| | | | |
|---|---|---|---|
| DE | 10 2013 110624 | A1 | 3/2015 |
| WO | 2007-061668 | A | 5/2007 |

* cited by examiner

CIRCULATING FLUIDIZED BED APPARATUS

The invention relates to a so-called circulating fluidized bed apparatus (CFBA), which main parts are:

- A combustion chamber [also called incinerator, incineration reactor, boiler etc.] with a gas permeable bottom at its lower end to allow the development of a fluidized bed of particulate material above said bottom, and at least one outlet port at its upper end to transfer a mixture of gas and solids from said combustion chamber via said outlet port into at least one subsequent separator (also-called: cyclone).
- Such a CFBA is disclosed inter alia by U.S. Pat. No. 6,802,890 B2. In a typical CFBA gas (air) is passed through the permeable grate-like bottom of the combustion chamber, which grate (grid) supports the fluidized bed of particulate material, the so-called incineration charge, which often includes a fuel-like material (combustible) such as coal and/or ash. This gives the fuel material and other components within the fluidized bed the behaviour of a boiling liquid.
- The reaction chamber (combustion chamber) is often water cooled and for this purpose limited by outer walls, made of tubes, through which water runs, wherein said tubes are either welded directly to each other to give a wall structure or with fins (ribs) between parallel running tube sections (hereinafter commonly referred to as heat exchange walls).
- The separator serves to separate the solids from the gas to its best. While at least part of the gas, separated from the solids, is often allowed to pass on from the separator to at least one subsequent treatment unit (for example a heat exchanger, filter element, chimney etc) for said gas, the solids (the particulate material, including ash) is passed on from the separator:
  - to at least one return duct and from there back into the combustion chamber and/or
  - to at least one solids heat exchanger and from there via corresponding recirculation means back into the combustion chamber and/or
  - extracted from the apparatus.
- Again the outer walls of the separator can be constructed as heat exchange walls (with continuous hollow spaces to allow water flowing therethrough).
- A typical design of such a separator is disclosed in U.S. Pat. No. 4,615,715 A.
- Means for the transfer of said solids from the separator into subsequent installations (like the heat exchanger or back into the combustion chamber) typically include a syphon to allow a decoupling of pressure between the respective installations (e. g. separator/combustion chamber).
- The solids heat exchanger allows to use the heat, provided by the solids (particulate material), for generating power, for example to heat up and to increase the pressure of a steam transported as a heat transfer medium via tubes/pipes/conduits or the like through said heat exchanger and/or through its outer walls (heat exchange walls) and further to turbines or similar power means.

All these features, mentioned above, describe a prior art CFBA and its components as disclosed for example in WO 2015/090636 A1. Insofar reference is made to the corresponding disclosure, as the skilled person is familiar with the general design.

Nevertheless there is a continuous demand for improvements, especially with respect to energy efficiency (typical capacity range: 50 to 800 MW, electrical), effectiveness, simple construction, avoidance of mechanical and thermal-mechanical stresses and compactness (typical data of a reactor chamber are: height: 30 to 60 m; width: 10 to 40 m; depth: 15 to 40 m).

Starting from a generic CFBA and its components as disclosed above, the invention is based on the following findings:

A generic combustion chamber typically features a box-shape with a substantially rectangular horizontal cross-section and correspondingly four outer walls, which extend at an angle of 90° to each other. In view of the size of said combustor and the overpressure, which prevails in it, huge efforts must be made to provide a strong/robust wall construction.

The arrangement of a subsequent separator and further subsequent ducts (conduits), heat exchangers etc requires considerable space which is not always available.

All of said components of a circulating fluidized bed apparatus (including ducts, syphons etc) cause heat losses when the hot gas/solids mixture leaves the combustion chamber until any re-entry into said combustion chamber.

To increase the heat transfer efficiency DE 31 07 356 A1 discloses a ring-shaped combustion chamber, which provides inner and outer heat exchange walls and different horizontal cross-sections over its height, and thus a larger heat exchange area compared with a box-shaped combustion chamber. It further discloses the arrangement of a multiplicity of separators inside the ring-shaped combustion chamber.

The invention adopts the ring-shape of a combustion chamber but subdivides this combustion chamber into two or more sections, wherein said sections are arranged adjacent to each other in a peripheral (circumferential) direction of the ring-shaped combustion chamber. In other words: One section is arranged after the other; all combined sections form said ring-shaped combustion chamber, wherein said "ring-shape" is not necessarily "closed" but may be interrupted between at least two adjacent sections, if required.

Each section is defined by its own inner wall (being a part of the overall inner wall of the combustion chamber), by its own outer wall (again being a part of the overall outer wall of the combustion chamber) and corresponding side walls (being intermediate, predominantly radially extending walls within the ring shaped combustion chamber), extending between said respective inner wall and outer wall, as well by a gas permeable bottom at its lower end (being an autarkic permeable bottom/grate or part of a larger permeable bottom, which extends over more than one section of the combustion chamber). Each section is fluidly connected to at least one outlet port to allow the mixture of solids and gas, treated within said section, to pass on into at least one associated separator. In other words: Each section provides the function of a combustion chamber of reduced size.

This subdivision of the combustion chamber into sections leads to smaller units (compartments), whereas the overall volume of the total number of sections remains substantially the same compared with a combustion chamber with one single ring-shaped combustion space.

The sections can be designed quite simply by providing intermediate walls, extending between an inner wall and an outer wall of the ring-shaped combustion chamber. These intermediate walls then define side walls of the respective sections.

These side walls increase the overall mechanical stability of the combustion chamber (and each section respectively)

characteristically and the same is true with respect to the inner wall and the outer wall of the combustion chamber, which are subdivided into a number of inner walls segments and outer wall segments, each defining an inner wall and an outer wall of a corresponding section. The mechanical stability of each individual section is considerably higher than that of a corresponding zone of an uninterrupted, continuous ring-shaped combustion chamber.

In its most general embodiment the invention relates to a circulating fluidized bed apparatus, comprising

- a combustion chamber, providing a bottom, which is gas permeable, at is lower end, to allow development of a fluidized bed of particulate material above said bottom, and at least one outlet port at its upper end to transfer a mixture of gas and solids from said combustion chamber via said outlet port into at least one subsequent separator, wherein the separator is designed
- to allow at least part of said solids, separated from the gas, to pass on to at least one return duct and from there back into the combustion chamber, or to pass on to at least one solids heat exchanger and from there via corresponding recirculation means back into the combustion chamber, or both, and
- to allow at least part of the gas, separated from the solids, to pass on to at least one subsequent treatment unit for said gas, wherein
- the combustion chamber is ring-shaped, comprising an inner wall and an outer wall, arranged at a distance to each other in a radial direction of the combustion chamber, and at least two intermediate walls, which extend between the inner wall and the outer wall and in spaced relationship in a circumferential direction of the combustion chamber, thereby subdividing the combustion chamber into a corresponding number of sections, arranged adjacent to each other in the circumferential direction of the combustion chamber.

The intermediate walls, providing side walls of the respective sections of the combustor, do not necessarily extend all the way from the lower end to the upper end of the combustion chamber but may end at a distance to the lower end (including the gas permeable bottom) and/or at a distance to the upper end (an upper ceiling of the combustion chamber).

Analogously this is true with respect to the radial dimension of the intermediate walls, which may extend continuously from the inner wall to the outer wall of the respective section or end at a distance to the inner and/or outer wall.

To achieve the desired effects of the sectional partition of the combustor space at its best, it is recommended to dimension the intermediate walls such that a corresponding vertical (virtual) plane between two adjacent sections is covered by at least 30% by said wall(s). The higher the percentage, the more effective is the integration of the intermediate walls. Percentages of >40%, >50%, >60%, >75%, >90% up to 100% are favourable options and dependent on the bespoke combustor.

The arrangement of the intermediate walls at a distance to the permeable bottom (grate) allows a construction with a permeable bottom, which stands in functional coaction with more than one section. Even one common gas permeable bottom may be provided below the multiplicity of combustor sections, allowing to provide one common fluidized bed of particulate material at the lower end of the said ring-shaped combustor chamber. In other words: the gas permeable bottom of adjacent sections may extend continuously over these adjacent sections.

Otherwise, if the side walls extend straight away from the perforated bottom (grate bottom), each section has "its own perforated bottom" and insofar its own fluidized bed on top of said bottom, allowing individual (bespoke) fluidized beds of particulate material and individual thermodynamic conditions in each respective section.

The sectional partition of the combustor chamber further allows to operate different sections under different conditions, for example:

- Different fuels and/or recycled ashes may be used in different sections to achieve different temperature loads, combustion degrees and/or thermodynamic efficiencies.
- Intermediate walls of different shape and/or size and/or construction allow to adapt the respective section to the required thermodynamic conditions. In this respect the intermediate walls can be heat exchange walls with water or steam flowing therethrough. This allows to designate the respective intermediate wall as a so-called reheater (German: Wiederaufheizer), evaporator (German: Verdampfer) or superheater (German: Uberhitzer) and thus to control the heat transfer in a considerably improved manner.
- The same effects are achievable by varying the size of the respective sections.

One or more sections may be linked to one or more subsequent separators and/or one or more heat exchangers, by which means the thermodynamic conditions of the CFBA may be influenced further.

According to one embodiment each section of the ring-shaped combustion chamber stands in fluidic communication with at least one outlet port, through which the mixture of solids and gas is transferred into at least one subsequent separator (cyclone), which may be arranged inside the ring-shaped combustor. This at least one outlet port may be arranged at the upper end of the corresponding section.

The outlet port may also be part of an adjacent section, if the corresponding side wall between these two sections allows a material transfer between these sections.

Reversely, at least two outlet ports of different sections (compartments) of the combustion chamber may merge into one (common) separator, which again may be arranged inside the ring-shaped combustion chamber.

The various outlet ports of the various sections can merge into one single common separator, which is arranged inside the ring-shaped combustion chamber. In other words: one central common separator is surrounded by the ring-shaped combustion chamber and its sections respectively.

All these embodiments reduce the complexity of the apparatus, increases the effectiveness of the apparatus and allows, i. a., to provide common walls for the separator and the associated sections insofar as the inner walls of these section(s) define(s) the outer wall of the separator(s) or vice versa.

Another embodiment relates to an apparatus wherein the outlet ports of different sections merge into different separators, arranged inside the ring-shaped combustion chamber.

While the number of sections may correspond to the number of separators, the number of separators may also differ from the number of sections. This includes embodiments characterized by a number of sections which equals or which is an even multiple of the number of separators, e.g. at least one separator may be assigned to at least two sections.

The ring-shape of the combustion chamber and correspondingly the shape of the inner wall and/or outer wall of the combustion chamber may have any specific design, e.g.

a circle, an oval, a triangle, alternatively a rectangle, a pentagon, a hexagon, a heptagon or an octagon, or generally spoken: any polygonal shape, and even combinations of both are possible.

It derives from this that (at least part of) the inner wall and/or (at least part of) the outer wall of at least one section can be curved or planar. Typically the total inner wall and/or the total outer wall will be curved or planar.

It further derives from this that the horizontal cross-section of individual sections may have the shape of a ring segment, rectangle, rhomb etc.

According to another embodiment the inner wall and at the outer wall of at least one section extend parallel to each other, wherein "parallel" includes concentric shapes in case of curved wall sections.

The overall inner and/or outer walls (boundaries) of the combustion chamber may be shaped as a circle, an oval, a triangle, a rectangle, a pentagon, a hexagon, a heptagon, an octagon or any other polygon.

An embodiment with adjacent sections, sharing a common side wall, allows optimizing the construction and heat exchange between the combustion spaces and its limiting walls (inner wall, outer wall and/or side walls, if partly or completely constructed as heat exchange walls).

Although not compulsory, at least one solids heat exchanger may be part of the CFBA (fluidicly arranged subsequent to the separator(s)), which heat exchanger(s) may best be placed within the space surrounded by said ring-shaped combustion chamber. The number of sections may be equal or being an even multiple of the number of solids heat exchangers.

While the interior construction of such heat exchanger may be according to prior art, the heat exchanger(s) used in connection with the new circulating fluidized bed apparatus may be equipped with more than one recirculation means, wherein different recirculation means merge into different sections of the combustion chamber. As an alternative there may be just one recirculation means being provided between each heat exchanger and an associated section.

The heat exchanger(s) may have a common wall with one or more of the adjacent/associated section(s), which again is favourable in view of the reduced complexity of the apparatus and energy efficiency, in particular if such walls are designed as heat exchange walls (water or steam are flowing through said walls and transferring the heat to subsequent installations).

This is true as well for an embodiment of the CFBA which comprises one single common solids heat exchanger, wherein the recirculation means of said common solids heat exchanger merge into at least two sections of the combustion chamber, while it is favourable to allow recirculation of the solids into all sections.

Any walls defining the section(s), separator(s) and heat exchanger(s) may be designed as heat exchange walls.

In this respect the one or more of the solids heat exchanger(s) may fulfil the function of a so-called economizer, superheater or reheater.

Further features of the invention derive from the features of the sub-claims as well as the other application documents.

The invention will now be described with respect to various embodiments, schematically illustrated in the attached drawing and representing in FIG. 1: a vertical cross-section of a circulating fluidized bed apparatus (CFBA)

Figure 2:
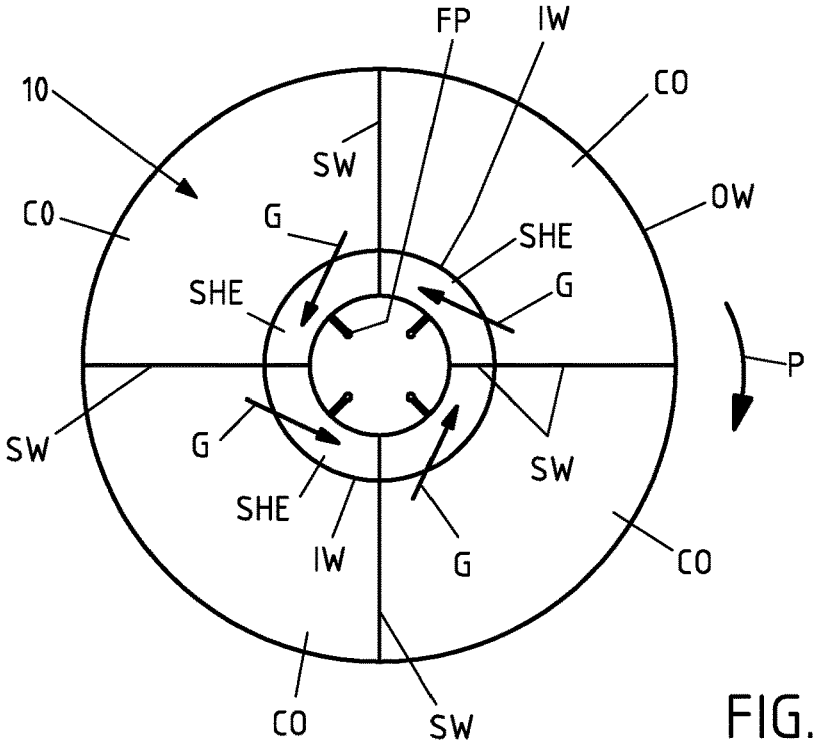
Figure 3:
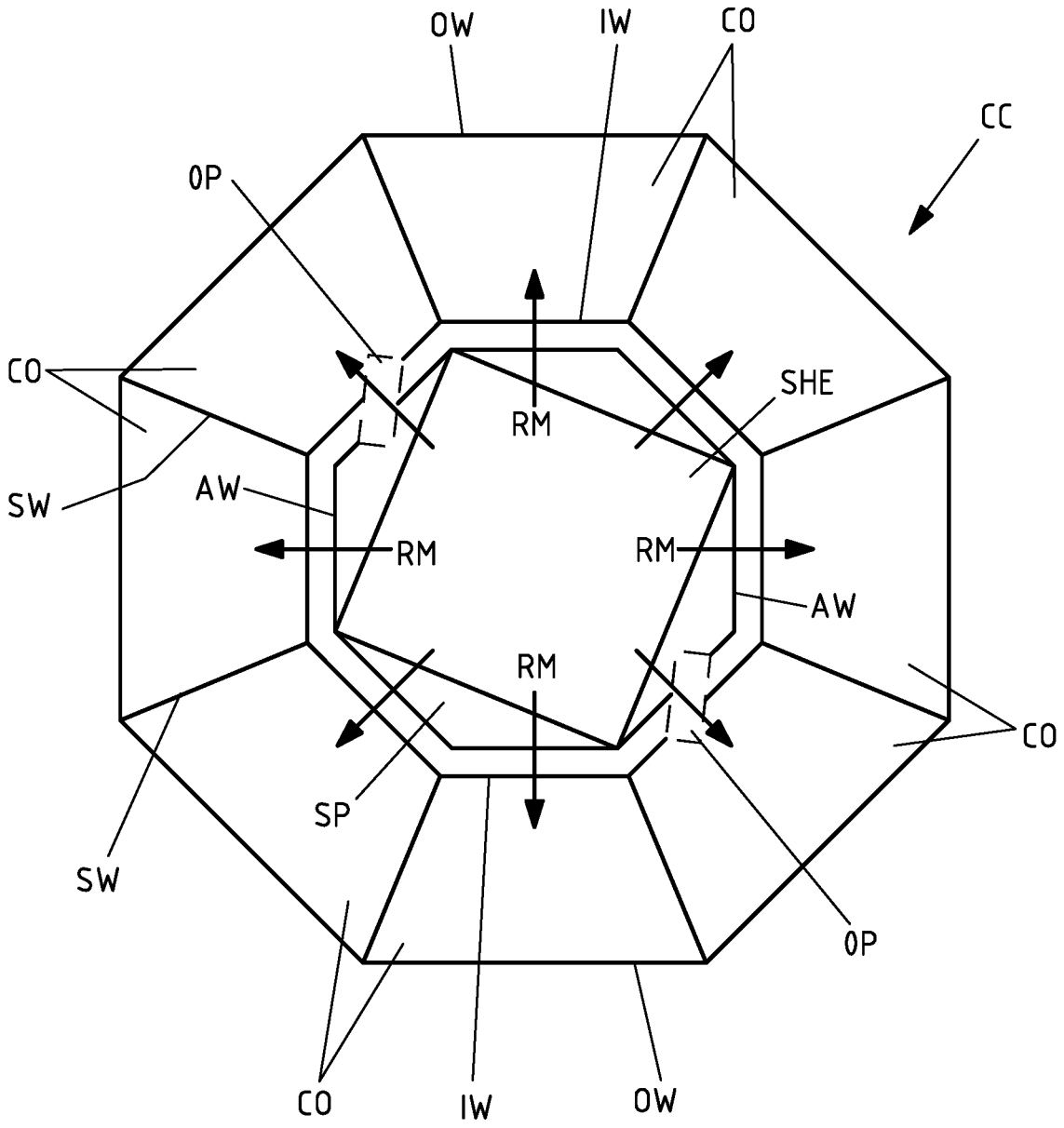

FIG. 2: a top view onto said CFBA of FIG. 1,

FIG. 3: a view from below onto a second embodiment of a CFBA

Figure 4:
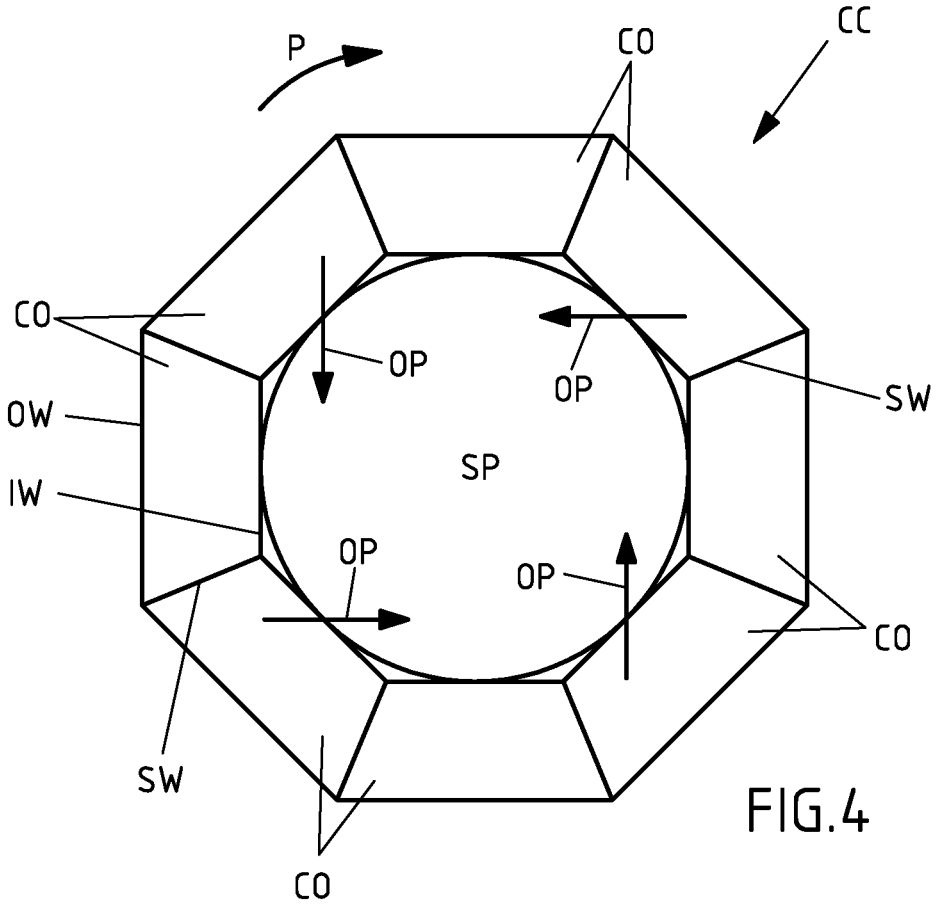

FIG. 4: a top view of a CFBA in a third embodiment

Figure 5:
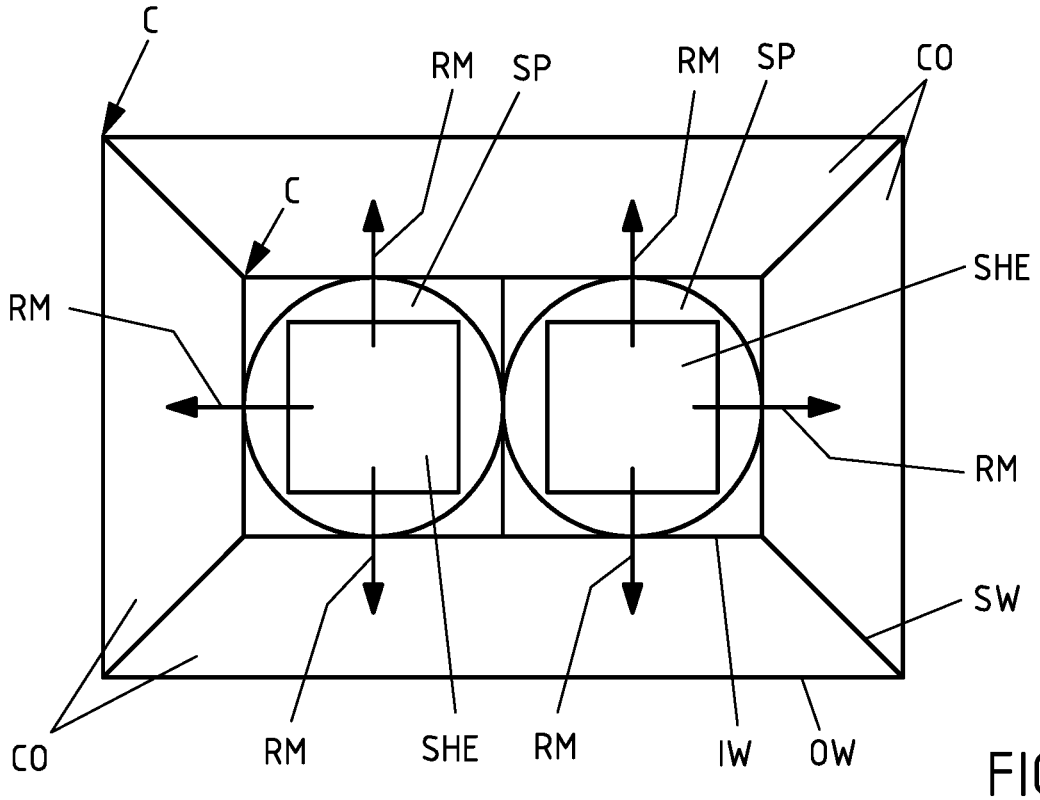

FIG. 5: a view from below onto a fourth embodiment of a CFBA

Figure 6:
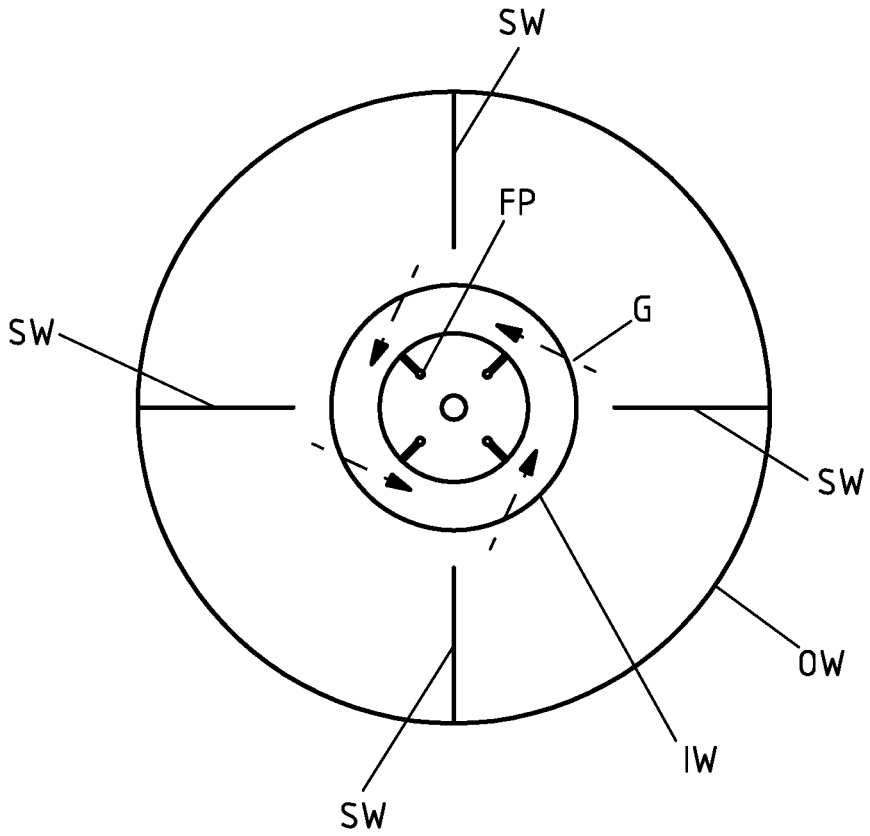

FIG. 6: a view according to FIG. 2 of a fifth embodiment of a CFBA

In the Figures functionally corresponding components are identified by the same numerals, independent on the respective embodiment.

FIGS. 1, 2 represent a circulating fluidizing bed apparatus, comprising a ring-shaped combustion chamber CC, which is subdivided into four discrete sections CO, arranged adjacent to each other in a peripheral/circumferential direction (FIG. 2: Arrow P) of said ring-shaped combustion chamber CC.

Each section CO is largely independent in functional terms and comprises an inner wall IW, an outer wall OW and side walls SW in between, a gas permeable bottom GB at its lower end LE and an outlet port OP at its upper end UE. All said inner walls IW and outer walls OW of sections CO represent one quarter of a circle-line. The four outer walls OW and the four inner walls IW form concentric circles.

Air is fed through said gas permeable (grate-like) bottom GB and symbolized by arrows A to establish a circulating fluidized bed of particulate material above said bottom. While the inlet port for a fuel material into the combustion chamber CC is represented by arrow JO, the fluidized bed is symbolized by FB.

A typical working temperature in the lower part of each section CO is about 800° C., while an overpressure of approximately 100 mbar prevails in the fluidized bed FB.

The gas-/solids-stream flowing upwardly in each of said sections CO exits each section CO at approximately the same or a slightly higher temperature and under substantially ambient pressure via corresponding openings (outlet ports) OP.

As may best be seen from FIG. 2 inner walls IW and outer walls OW of all four sections follow each other to form two concentric circles, while the outlet ports OP are arranged in such a way as to give the gas-/solids-stream a substantially tangential direction (arrows G) in FIGS. 1, 2.

Said inner walls IW of the four sections CO, which are made of tube-like walls with fins in between, wherein the tubes are water-cooled tubes, represent an upper part of an outer wall of a separator (cyclone) SP, arranged within a cylindrical space CP defined by said inner walls IW.

While the lower part LP of the cyclone SP tapers in a conventional way, return ducts RD extend from the lower part LP of the separator SP to allow solids, collected within the lower part LP of the separator SP, to be fed into the lower end LE of the combustion chamber CC. In this embodiment there are four return ducts RD, each of which bridges one of said four sections CO and the common separator SP. To overrule any pressure differences between the sections CO and the separator SP, a syphon SY is arranged at each return duct RD.

The same is true with respect to feeding pipes FP with intermediate syphons SY, through which another part of the solids, collected in the separator SP, is transported into corresponding solids heat exchangers SHE.

In the embodiment represented in FIGS. 1, 2 four solid heat exchangers SHE are provided, one after the other in the circumferential direction (arrow P) of the ring-shaped combustor chamber CC. Insofar the four heat exchangers SHE, through which the solids flow on their way back into the combustor's sections CO, again display a circular ring-shape, which ring-shape extends concentrically to the ring-shape of the four combuster sections CO. This allows to use the inner walls IW of the four sections CO as outer walls of the four heat exchangers SHE and to use side walls SW between adjacent heat exchangers SHE as common walls between two heat exchangers SHE. For this purpose the side walls SW of the sections CO have been extended at their inner ends according to the embodiment displayed.

While the construction of each of said heat exchangers SHE may be of the conventional type, recirculation means RM are provided at each of said heat exchangers SHE to allow a recirculation (return) of the solids into the respective section CO and the fluidized bed FB respectively. These recirculation means RM, schematically represented by corresponding arrows in FIG. 1, are wall openings, but can also be designed as ducts or the like.

A gas duct GD extends from an upper part of the separator SP and leads to (non displayed) subsequent treatment units for the gas, which was previously separated from the solids within the separator SP.

The embodiment according to FIG. 3 differs from that of FIG. 1, 2 by the following features:

The ring-shaped combustion chamber CC is subdivided into eight sections CO, each with planar inner and outer walls IW, OW, extending parallel to each other to give each section a rhomboid-like horizontal cross-section, wherein sidewalls SW extend between the corresponding corner-sections of said inner walls IW and outer walls OW. The outer geometry of the combustion chamber CC follows an octagon.

The separator SP has an octagonal outer shape and its outer walls are arranged at a short distance to the inner walls IW of said sections CO.

Each section CO has one outlet port OP at its upper end UE, which outlet port OP again is arranged in a way to allow the gas-/solids-stream, deriving from a section CO and entering the separator SP, to flow more or less "tangential", i.e. more or less parallel to an adjacent wall AW of the separator SP. Only two of eight outlet ports OP and subsequent walls AW are illustrated in FIG. 3.

Instead of a multiplicity of solids heat exchangers SHE the embodiment of FIG. 3 has just one common heat exchanger SHE below said separator SP. Insofar the number of feeding pipes FP may be less than the number of sections CO and may be even down to one single feeding pipe FP. The heat exchanger SHE is box shaped (four walls and right angles between adjacent walls) but may have any other shape.

The number of recirculation means RM, in this embodiments designed as ducts, by which the solids, which have passed the solids heat exchanger SHE, are fed back into the combustor, corresponds to the number of sections CO (here: eight) to allow one recirculation means RM to enter each section CO.

FIG. 3 again displays the arrangement of adjacent sections CO one after the other to give an overall ring-shaped combustion chamber CC, wherein each section CO with its rhomboid horizontal cross-section represents an autarkic combustion chamber of high structural integrity because of its small size and angled walls, allowing to set different thermodynamic conditions in different sections.

The same is true with respect to the embodiment according to FIG. 4, which differs from that of FIG. 3 in particular by the following:

While the outer profile (in a horizontal cross-section) of the embodiment of FIG. 4 is again octagonal, the number of sections has been reduced from eight to four by deleting every second sidewall SW.

Correspondingly the number of outlet ports OP has been reduced to four, although each section CO may have more than one outlet port OP.

The CFBA of FIG. 4 operates with one common separator SP, which differs from that of FIG. 3 insofar as it has a circular horizontal cross-section, wherein the upper part of said separator SP partially touches the inner walls IW of said four sections CO.

At its lower part return ducts to the combustion chamber CC are fitted, while part of the solids is extracted directly from the separator SP without returning them into any of the sections CO. In this embodiment no heat exchanger(s) being provided.

The embodiment of FIG. 5 displays a rectangular combustion chamber CC with four sections CO, one next to the other, each with a rhombic horizontal cross-section and insofar with sidewalls SW extending between corresponding corners C-C of said outer walls OW and inner walls IW of adjacent sections CO.

Two cylindrical separators SP are arranged side by side inside the ring-shaped combustion chamber CC.

Beneath each of said separators SP a corresponding solids heat exchanger SHE of a square inner and outer profile is arranged.

Outlet ports of two adjacent sections CO merge into one separator SP, while the outlet ports of the other two sections lead into the second separator SP. Return ducts RD between the lower part LP of each separator SP and adjacent sections CO allow the solids to be returned into the combustion space and fluidized bed FB respectively.

Feeding pipes FP are arranged between each of said two separators SP and a corresponding solids heat exchanger SHE. The solids, having passed the solids heat exchangers SP, are then returned into the two sections CO via recirculation ducts (arrows RM).

In the embodiment of FIG. 5 each of said solids heat exchangers SHE has a square horizontal cross-section and is arranged at a distance to the inner walls IW of adjacent sections CO.

FIG. 6 represents an embodiment similar to that of FIG. 1, 2 with the proviso that the intermediate (side) walls SW do not extend over the full vertical height H and full horizontal width W of the sections CO, but at a distance to the bottom grate (gas permeable bottom GB) and with a distance to the inner wall IW. This allows to extend one common permeable bottom GB over more than one section (compartment) CO, while at the same time at least part of the solids/gas mixture may pass from one section CO into the adjacent one through that gap between inner wall IW and side wall SW. Both height and width of the side walls SW are dimensioned such that the side walls SW cover about 70% of the maximum (virtual) plane between adjacent sections CO. All inner and outer walls IW, OW and all side walls are water cooled walls made of steel tubes, through which water flows, and steel fins between adjacent steel tubes.

Features of the embodiments displayed may be combined arbitrarily, if technically useful and not explicitly excluded.

The invention claimed is:

1. A circulating fluidized bed apparatus, comprising a) a combustion chamber (CC) providing a bottom (GB), which is gas-permeable, at its lower end (LE), to allow development of a fluidized bed (FB) of particulate material above said bottom (GB), and at least one outlet port (OP) at its upper end (UE) to transfer a mixture of gas and solids from said combustion chamber (CC) via said outlet port (OP) into at least one subsequent separator (SP), wherein the separator (SP) is designed b) to allow at least part of said solids, separated from the gas, to pass on to at least one return duct (RD) and from there back into the combustion chamber (CC) or to pass on to at least one solids heat exchanger (SHE) and from there via corresponding recirculation means (RM) back into the combustion chamber (CC), or both, and c) to allow at least part of the gas, separated from the solids, to pass on to at least one subsequent treatment unit for said gas, wherein d) the combustion chamber (CC) is ring-shaped, comprising an inner wall (IW) and an outer wall (OW), arranged at a distance to each other in a radial direction of the combustion chamber (CC), and at least two intermediate walls (SW), which extend between the inner wall (IW) and the outer wall (OW) and in spaced relationship in a circumferential direction of the combustion chamber (CC), thereby subdividing the combustion chamber (CC) into a corresponding number of sections (CO), arranged adjacent to each other in the circumferential direction of the combustion chamber (CC).

2. The circulating fluidized bed apparatus of claim 1, wherein each section (CO) of the ring-shaped combustion chamber (CC) stands in fluidic communication with the at least one outlet port (OP), through which the mixture of solids and gas is transferred into the at least one subsequent separator (SP), which is arranged inside the ring-shaped combustion chamber (CC).

3. The circulating fluidized bed apparatus of claim 1, wherein at least two outlet ports (OP) of different sections (CO) of the combustion chamber (CC) merge into one common separator (SP), which is arranged inside the ring-shaped combustion chamber (CC).

4. The circulating fluidized bed apparatus of claim 1, wherein each intermediate wall (SW) covers at least 30% of a plane which extends between corresponding adjacent sections (CO).

5. The circulating fluidized bed apparatus of claim 1, wherein the number of sections (CO) equals or is an even multiple of the number of separators (SP).

6. The circulating fluidized bed apparatus of claim 1, wherein the inner wall (IW) and the outer wall (OW) of at least one section (CO) of the ring-shaped combustion chamber (CC) are planar.

7. The circulating fluidized bed apparatus of claim 1, wherein the inner wall (IW) and the outer wall (OW) of at least one section (CO) of the ring-shaped combustion chamber (CC) extend parallel to each other.

8. The circulating fluidized bed apparatus of claim 1, wherein the inner wall (IW) or the outer wall (OW) of the combustion chamber (CC), or both, are shaped as a circle, an oval, a triangle, a rectangle, a pentagon, a hexagon, a heptagon or an octagon.

9. The circulating fluidized bed apparatus of claim 1, wherein adjacent sections (CO) share a common intermediate wall (SW).

10. The circulating fluidized bed apparatus of claim 1, wherein the gas permeable bottoms (GB) of adjacent sections (CO) of the ring-shaped combustion chamber (CC) extend continuously over these adjacent sections (CO).

11. The circulating fluidized bed apparatus of claim 1 with the at least one solids heat exchanger (SHE) being equipped with more than one recirculation means (RM) for the solids, wherein different recirculation means (RM) merge into different sections (CO) of the ring-shaped combustion chamber (CC).

12. The circulating fluidized bed apparatus of claim 1, wherein the at least one solids heat exchanger (SHE) has a common wall (IW, CW) with an adjacent section (CO) of the ring-shaped combustion chamber (CC).

13. The circulating fluidized bed apparatus of claim 1, wherein the number of sections (CO) equals or is an even multiple of the number of solids heat exchangers (SHE).

14. The circulating fluidized bed apparatus of claim 1, comprising one common solids heat exchanger (SHE), wherein the recirculation means (RM) of the common solids heat exchanger (SHE) merge into at least two sections (CO) of the ring-shaped combustion chamber (CC).

15. The circulating fluidized bed apparatus of claim 1, wherein at least one of the inner wall (IW), the outer wall (OW) or the intermediate walls (SW) of the combustion chamber (CC) is designed to allow a fluid or a steam to flow through.

* * * * *